US009650779B2

(12) United States Patent
Tello

(10) Patent No.: US 9,650,779 B2
(45) Date of Patent: May 16, 2017

(54) ADJUSTABLE FORK CONNECTOR FOR CONNECTING TRUSSES

(71) Applicant: Tyler Truss Systems, Inc., Pendleton, IN (US)

(72) Inventor: Jason Tello, Pendleton, IN (US)

(73) Assignee: Tyler Truss Systems, Inc., Pendleton, IN (US)

( * ) Notice: Subject to any disclaimer, the term of this patent is extended or adjusted under 35 U.S.C. 154(b) by 0 days.

(21) Appl. No.: 15/058,283

(22) Filed: Mar. 2, 2016

(65) Prior Publication Data

US 2016/0273210 A1 Sep. 22, 2016

Related U.S. Application Data

(60) Provisional application No. 62/134,861, filed on Mar. 18, 2015.

(51) Int. Cl.
*E04B 1/24* (2006.01)
*E04C 3/04* (2006.01)

(52) U.S. Cl.
CPC ..... *E04B 1/2403* (2013.01); *E04C 3/04* (2013.01); *E04B 2001/2439* (2013.01); *E04B 2001/2472* (2013.01)

(58) Field of Classification Search
CPC ..... E04B 1/2403; E04B 2001/2472; E04B 2001/2439; E04B 2001/2406; E04B 2001/2409; E04B 2001/2457; E04C 3/04; E04C 2003/0486
USPC ..... 52/848, 849, 692, 643
See application file for complete search history.

(56) References Cited

U.S. PATENT DOCUMENTS

| | | | | |
|---|---|---|---|---|
| 2,982,379 | A | 5/1961 | Fisher | |
| 3,011,586 | A | 12/1961 | Harvey, Jr. | |
| 3,727,362 | A * | 4/1973 | Ellison | E04B 5/14 403/174 |
| 3,783,573 | A | 1/1974 | Vaughan | |
| 4,352,255 | A | 10/1982 | Warehime | |
| 4,819,399 | A | 4/1989 | Onoda | |
| 5,125,206 | A | 6/1992 | Motohashi et al. | |
| 5,711,131 | A | 1/1998 | Thomas | |
| 6,408,587 | B2 * | 6/2002 | Cronin | B44C 1/28 52/385 |
| 6,675,546 | B2 * | 1/2004 | Coles | F16C 11/045 403/157 |
| 7,963,084 | B2 | 6/2011 | Merrifield et al. | |
| 8,099,913 | B1 * | 1/2012 | Dodd | A63J 1/02 182/150 |
| 8,641,312 | B2 * | 2/2014 | Todd, IV | E04H 3/28 403/165 |
| 8,950,716 | B2 * | 2/2015 | Kempf | F16M 13/02 248/229.2 |
| 2004/0144413 | A1 | 7/2004 | Matthews et al. | |

(Continued)

*Primary Examiner* — Brent W Herring
(74) *Attorney, Agent, or Firm* — Woodard, Emhardt, Moriatry, McNett & Henry LLP

(57) ABSTRACT

An adjustable fork connector to connect adjacent trusses. A hollow tube is mountable to the end of a first truss and has a pair of spaced apart flanges to extend vertically or horizontally. The flanges are longitudinally movable to position the flanges a selected distance outward from the first truss. A single flange is rotatably mounted to the second truss and is extendable between the pair of flanges and removably connected thereto.

3 Claims, 5 Drawing Sheets

(56) References Cited

U.S. PATENT DOCUMENTS

| | | | | |
|---|---|---|---|---|
| 2005/0210814 | A1* | 9/2005 | Hawes | E04C 3/005 52/648.1 |
| 2011/0023406 | A1* | 2/2011 | Todd, IV | E04H 3/28 52/655.1 |
| 2013/0161477 | A1* | 6/2013 | Kempf | F16M 13/02 248/674 |
| 2015/0289493 | A1* | 10/2015 | Baugh | A01K 97/10 43/4.5 |

* cited by examiner

ADJUSTABLE FORK CONNECTOR FOR CONNECTING TRUSSES

BACKGROUND OF THE INVENTION

Field of the Invention

The present invention relates generally to the field of trusses used to support a variety of appliances, such as lights. More specifically, a connector is disclosed for connecting together adjacent trusses.

Description of the Prior Art

Trusses typically have fixed lengths which may be of insufficient length to span the required distance. As a result, a multiple trusses are aligned to extend over the particular span. The trusses are connected together such as disclosed in U.S. Pat. No. 8,028,488 wherein identical trusses are connected together at their adjacent ends by mating flanges and removable pins extending through the flanges. Such technique requires the adjacent trusses to be aligned to enable the pins to extend through the end flanges of one truss and the end flanges of the adjacent truss. As a result, time and effort is required to first align the trusses and then hold the trusses in alignment while the removable pins are inserted into the flanges. Disclosed herein is a new connector to be used to connect adjacent trusses which may or may not be in perfect alignment.

SUMMARY OF THE INVENTION

A connector for connecting a first truss having a tube with a first hollow end to a second truss having a second hollow end. A flanged shank is removably insertable in the tube and has a flange to connect to a flanged end of the second truss thereby connecting the first truss to the second truss. The flanged shank of the first truss may be positioned manually adjacent the flanged end of the second truss.

It is an object of the present invention to provide a coupling allowing easy connection of adjacent trusses that may or may not be in perfect alignment.

It is a further object of the present invention is to provide a coupling that may be installed on trusses to allow for a quick connection between trusses.

Related objects and advantages of the present invention will be apparent from the following description.

DESCRIPTION OF THE PREFERRED EMBODIMENT

Figure 1:
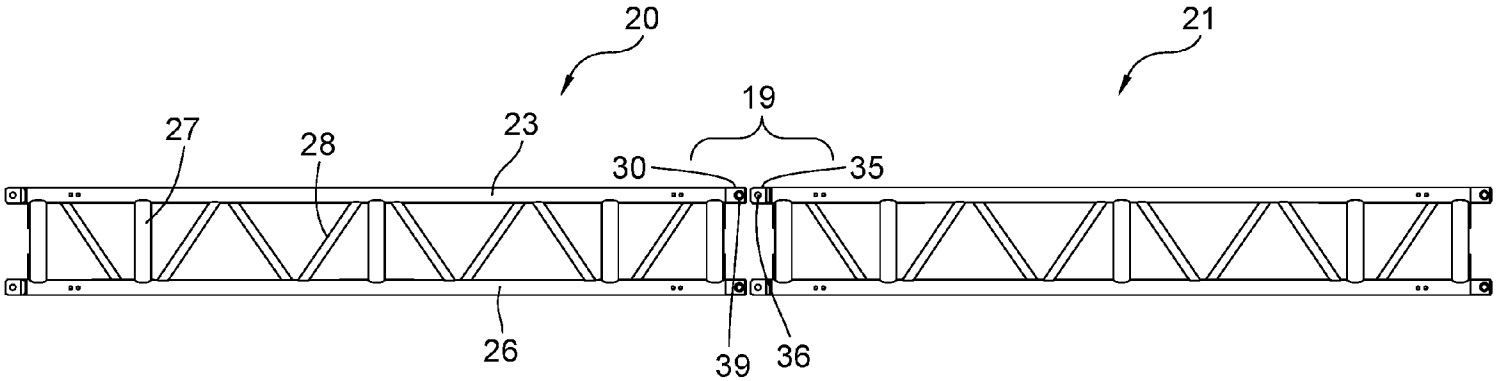
Fig. 1 (PRIOR ART)
FIG. 1 is a side view of a pair of prior art trusses.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
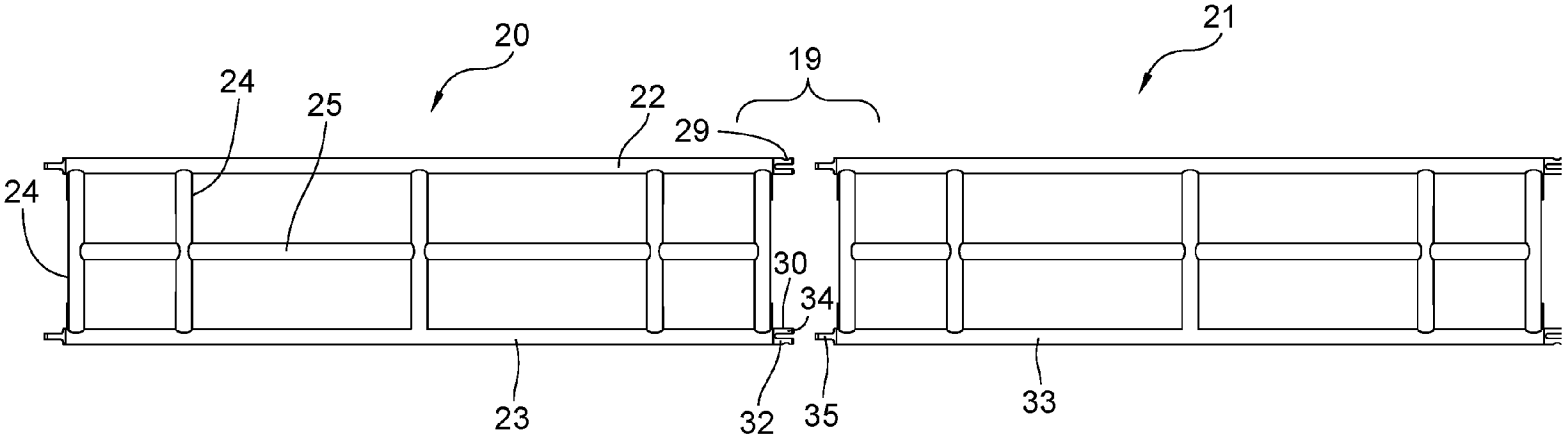
Fig. 2 (PRIOR ART)
FIG. 2 is a top view thereof.

FIGS. 1 and 2 show respectively a side and top view of a pair 19 of prior art identical trusses 20 and 21 securable together. Truss 20 will now be described it being understood that an identical description applies to truss 21. Truss 20 includes four horizontally extending tubular members connected together. In the top view of FIG. 2, the horizontally extending members include members 22 and 23 joined together by a plurality of cross-members 24 perpendicularly arranged and having their opposite ends fixedly attached to tubes 22 and 23. A centrally located horizontally extending tube 25 is parallel to tubes 22 and 23 being joined to cross members 24. Tubes 22 and 23 along with the cross members 24 and central member 25 form a generally rectangular top frame which is replicated on the bottom of the truss and is identical thereto. In the side view of FIG. 1, the bottom frame is formed by a pair of horizontally extending tubes one of which is shown as member 26. The two spaced apart bottom horizontally extending members 26 are fixedly secured to the horizontally extending top members 22 and 23 by a plurality of vertical members 27 and a plurality of angular members 28. Thus, in FIG. 1, the two bottom horizontal members 26 are joined to the top horizontal member 23 and 24 by members 27 and 28.

Mounted to the opposite ends of the four horizontally extending tubes are flanges to enable one truss to be connected to an adjacent truss. For example, identical prior art connectors 29 and 30 are fixedly secured respectively to tubes 22 and 23 and also to the two bottom tubes 26 with each connector having a pair of spaced apart flanges forming a gap. For example, connector 30 has a pair of flanges 32 and 34 spaced apart to receive the single flange 35 fixedly mounted to the end of horizontally extending member 33 of truss 21. Likewise, a flange identical to flange 35 is provided on each of the horizontally extending tubes of truss 21 to extend into the gap of the adjacent connectors of truss 20. The flanges of each truss are provided with an aperture through which a removable pin extends to connect the trusses together. For example, connector 30 has an aperture 39 extending through flanges 32 and 34 that is alienable with aperture 36 extending through the single flange 35. In a similar manner, the adjacent ends of the horizontally extending tubes of members 20 and 21 are connected together. Such a construction is well known in the industry and forms a part of the prior art.

Figure 3C:
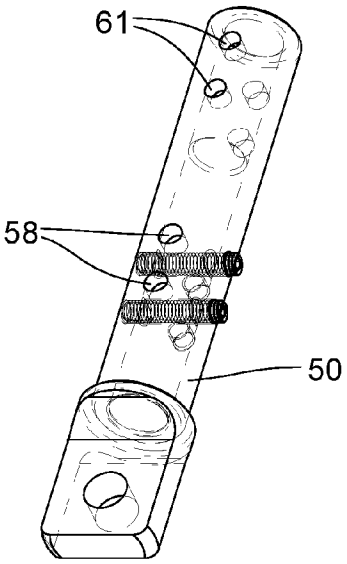
FIG. 3C is the same view as FIG. 3B only with the flange extending in the horizontal direction.
Figure 3B:
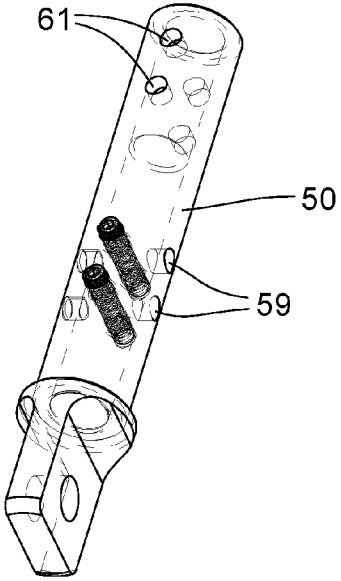
FIG. 3B is a perspective view of the assembled connector of FIG. 3A showing the male flange extending in the vertical direction.
Figure 3A:
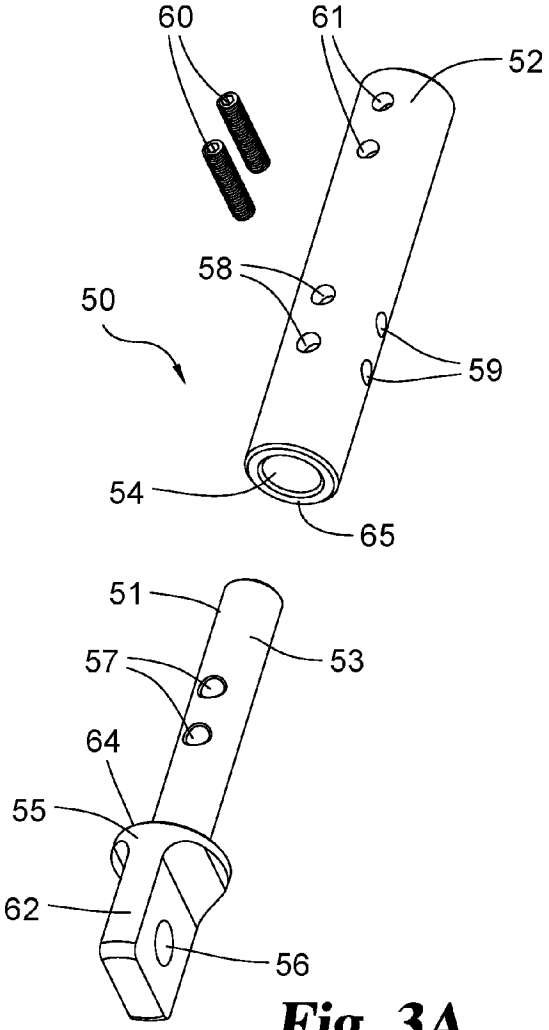
FIG. 3A is an exploded perspective view of the preferred embodiment of the male connector incorporating the present invention to secure adjacent trusses together.
Figure 4C:
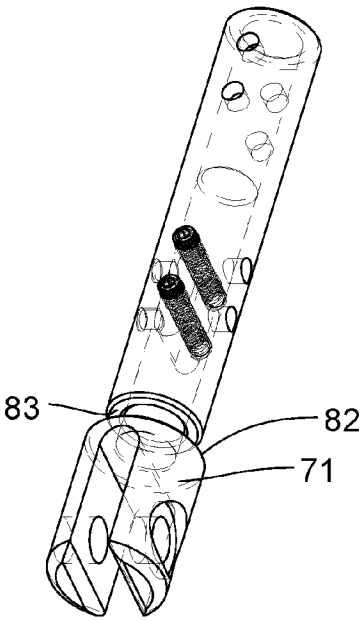
FIG. 4C is the same view as FIG. 4B only showing the female fork-end in an extended position and with the fork-end.
Figure 4B:
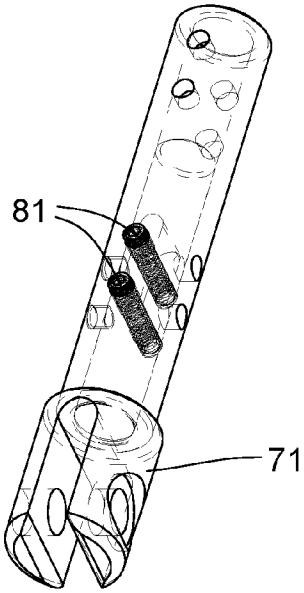
FIG. 4B is a perspective view of the connector of FIG. 4A only in the assembled position with the female fork-end extending in the vertical direction and located in an inward position.
Figure 4A:
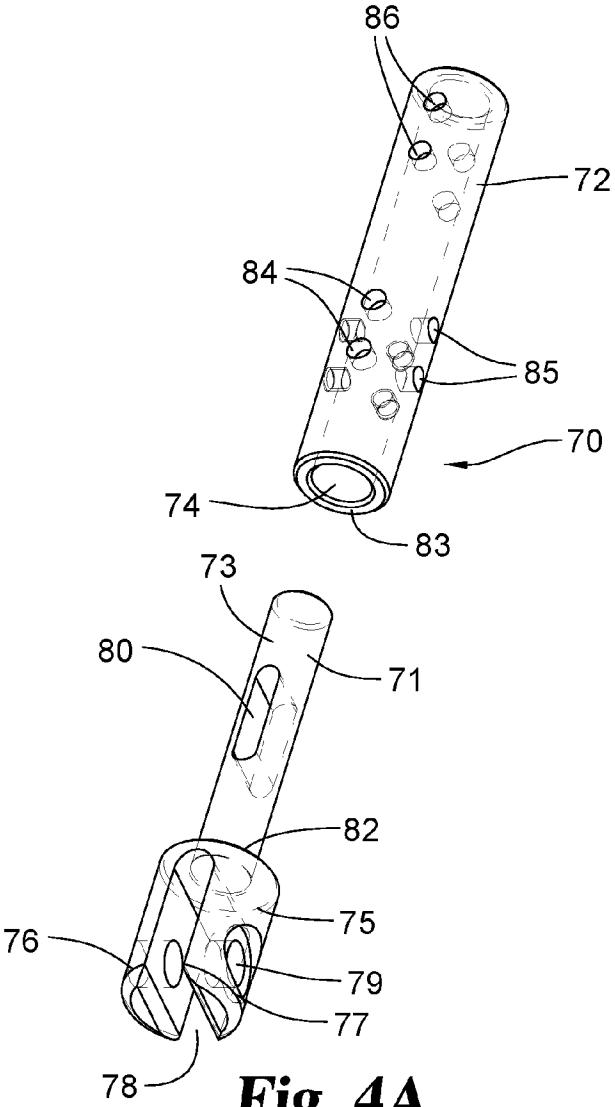
FIG. 4A is an exploded perspective view of the preferred embodiment, slidable fork-end female connector.
Figure 4D:
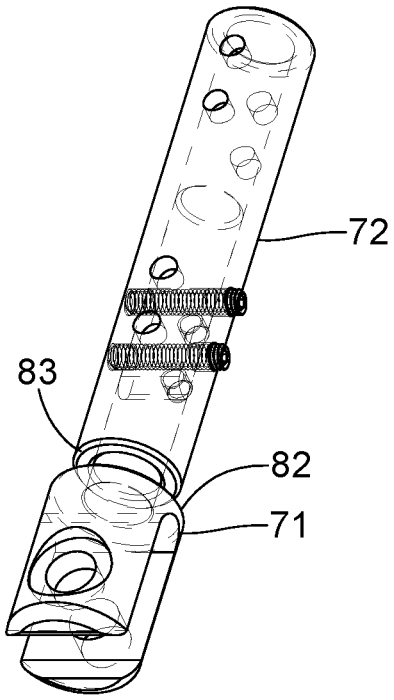
FIG. 4D is the same view as FIG. 4C only showing the extended female fork-end rotated so that the fork-end extends in the horizontal direction.
Figure 5:
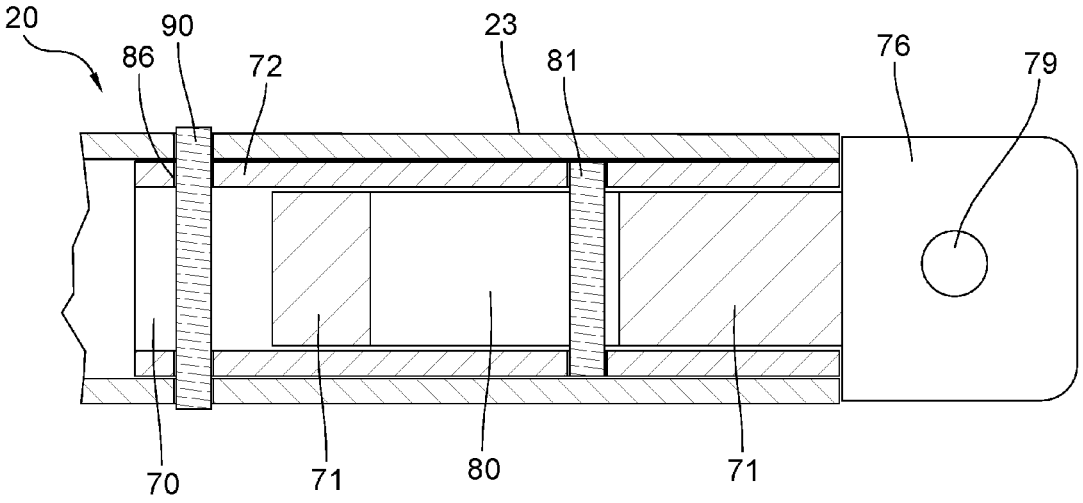
FIG. 5 is a fragmentary, enlarged, cross-sectional view of the end of truss tube 23 showing receiver 72 inserted therein and female fork-end 71 inserted into receiver 72.
Figure 6:
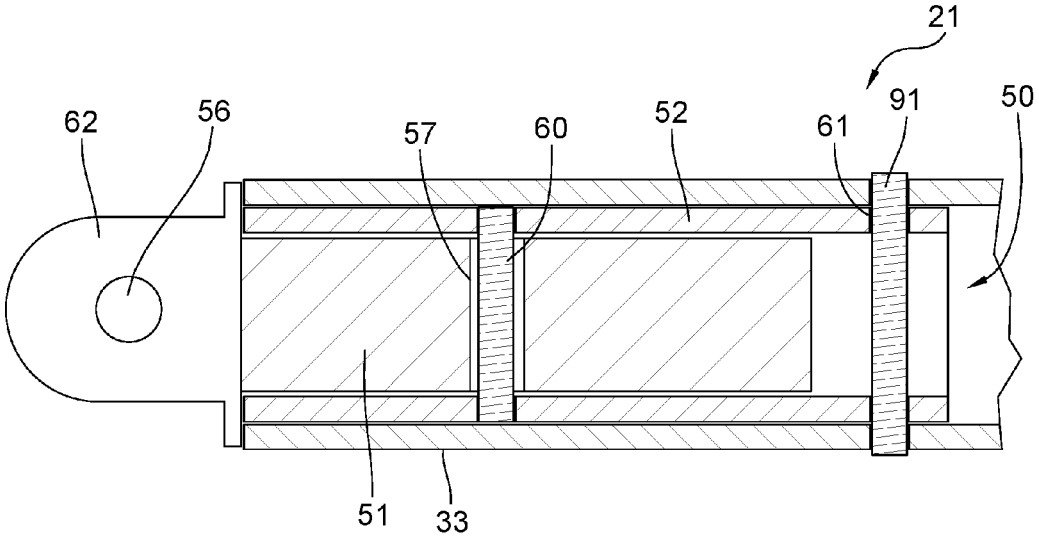
FIG. 6 is a fragmentary, enlarged, cross-sectional view of the end of truss tube 33 showing receiver 52 inserted therein and male fork-end 51 inserted into receiver 52.

FIGS. 3*a-c* and 4*a-d* disclose connectors incorporating the present invention that replace connectors 29 and 30 and flanges 35. The connectors of FIGS. 3 and 4 are adjustable and allow for easy connection of adjacent trusses. Such adjustment can be accomplished in the field when the truss is in any position including a lowered position or an elevated position. FIG. 5 illustrates connector 70 mounted to truss 20 whereas FIG. 6 illustrates connector 50 mounted to truss 21.

FIG. 3A illustrates an exploded perspective view of connector 50 consisting of a cylindrical tubular receiver 52 into which the shank of the male fork-end 51 is inserted. Fork-end 51 has a cylindrical main body or shank 53 insertable into the hollow interior 54 of receiver 52 with the opposite end of the main body including a single flange 62 having an aperture 56 through which a removable pin may be inserted. Holes 57 extend through the cylindrical main body 53 and are alienable with holes 58 or 59. In the event flange 62 extends vertically (FIG. 3B) and hole 56 extends horizontally, then holes 57 are aligned with holes 58 whereas if flange 62 extends horizontally (FIG. 3C) and hole 56 extends vertically then holes 57 are aligned with holes 59 with set screws 60 extending freely through holes 58 or 59 as the set screws are threaded through holes 57. Thus the flange of the fork-end can extend either horizontal or vertical depending upon the orientation of the gap formed by a pair of spaced apart flanges mounted to the end of an adjacent truss. Holes 61 extend through receiver 52 and are alienable with holes provided in one end of the horizontally extending tubes 33 of truss 21 with set screws 91 (FIG. 6) being provided to secure the receiver fixedly to the horizontally extending tubes.

Once male fork-end 51 is inserted in receiver 52, the flange 62 can be manually rotated to extend either vertically as shown in FIG. 3B or horizontal as shown in FIG. 3C. The set screws are then installed securing fork-end 51 to the receiver. An enlarged washer shaped portion 55 is provided on flange 62 providing a stop surface 64 abutable against the end 65 of the receiver. Holes 58, 59 and 61 extend through the opposite side walls of receiver 52. The connector shown in FIGS. 3A-3C thereby provides a 90 degree rotatable male fork-end. Receiver 52 is then inserted into the end of one of the horizontally extending tubes 33 (FIG. 6) of truss 21 with set screws 91 extending threadedly through tubes 33 and freely through holes 61 provided in receiver 52.

FIGS. 4A-4D disclose a telescopic sliding female fork-end that has the flanges rotatable through 90 degrees. An exploded view of connector 70 has a tubular receiver 72 into which the shank 73 of the female fork-end 71 extends. Fork-end 71 has a cylindrical main body slidable into the hollow interior 74 of receiver 72. Mounted to the end of main body 73 is the fork-end configuration 75 formed by a pair of spaced apart flanges 76 and 77 forming a gap 78 into which flange 62 of connector 50 is extendable. In the event connector 50 is not utilized then connector 70 may be used to receive the fixed single flange 35 of the prior art connectors depicted in FIG. 1. In either case, a hole 79 extends through flanges 76 and 77 to receive a removable pin which also extends through an aperture in the single flange 62 or 35 mounted to the adjacent truss. A slot 80 extends through main body 73 and is oriented to extend in the direction of the lengthwise extending longitudinal axis of main body 73. Set screws 81 (FIG. 4B) are threadedly received by internally threaded apertures 84 or 85 that extend through the side walls of the main body of receiver 72. The set screws extend freely through slot 80 allowing the fork-end 71 to move in telescopic fashion. For example, stop surface 82 of fork-end configuration 75 abuts the outwardly facing edge 83 of receiver 72 when the fork-end 71 is in a non-extended position relative to the receiver illustrated in FIG. 4*b*. Fork-end 71 may also be extended so that surface 82 is spaced apart from edge 83 thereby allowing for a different spacing between opposite ends of adjacent trusses.

As with the case of the connector 50 shown in FIG. 3, connector 70 has a second pair of internally threaded holes 85 (FIG. 4A) that extend through the opposite side walls of receiver 72 to threadedly receive the set screws 81 when the flanges 76 and 79 extend horizontally providing a horizontally extending gap 78.

A pair of internally threaded holes 86 extend through the opposite side walls of the receiver and threadedly receive a pair of set screws extending freely through holes provided at the end of the horizontally extending tubes 22, 23 and 26 of truss 20. Thus, connector 70 has multiple positions. In the first position, the sliding female fork-end is in a retracted position so that surface 82 abuts edge 83 with the flanges being rotated to either a vertical or horizontal position depending upon whether the gap between the flanges is to extend vertically or horizontally. When the fork-end 71 is extended (FIGS. 4C and 4D), the flanges can also be positioned to either extend vertically (FIG. 4C) or horizontally (FIG. 4D). Holes 86 extend through receiver 72 and are alienable with holes provided in one end of the horizontally extending tubes 22, 23, 26 of truss 20 with set screws 90 (FIG. 5) securing the receiver fixedly to the horizontally extending tubes.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. The combination of:

a first truss with a first end;

a second truss with a second end alignable relative to said first end;

a tubular shaped receiver having a longitudinal axis and being removably mounted to and extending into said first end of said first truss;

a first fastener securing said receiver to said first end of said first truss;

a first shank slidably and telescopically mounted to said receiver, said first shank including a shank portion extending into said tubular shaped receiver and further having a flanged end, said flanged end being rotatable with said shank portion to position said flanged end to extend either in vertical or horizontal positions while also being slidable relative to said receiver while said flanged end remains in either said vertical or horizontal positions, said flanged end positionable between said first end of said first truss and said second end of said second truss with said flanged end positioned adjacent and removably connected to said second end of said second truss;

a second fastener securing said shank portion of said first shank to said receiver while allowing said first shank to slide relative to said receiver in a direction of said axis;

a second shank connected to said second truss, said second shank having one flange which is matable with said flanged end of said first shank; and, a third fastener extending through said one flange and said flanged end removably connecting said first truss and said second truss together.

2. The combination of claim 1 wherein:

said flanged end includes two flanges fixedly mounted to said first shank, said two flanges spaced apart forming a gap into which said one flange of said second end of said second truss extends while connected to said two flanges.

3. The combination of claim 2 and further comprising:

a tube extending into said second end of said second truss, said second shank extending into said tube;

a fourth fastener securing said tube to said second end of said second truss preventing relative motion between said tube and said second end of said second truss; and a fifth fastener securing said second shank to said tube preventing relative motion between said second shank and said tube whereas said shank portion of said first shank has a slot through which said second fastener extends freely through allowing slidable motion along said axis between said first shank and said receiver.

* * * * *